United States Patent [19]

Knight

[11] 4,418,890

[45] Dec. 6, 1983

[54] WEDGE WITH FLANGES

[76] Inventor: Alan Knight, 1349 Hanover Ct., Circleville, Ohio 43113

[21] Appl. No.: 311,859

[22] Filed: Oct. 16, 1981

[51] Int. Cl.[3] ..... B66F 11/00

[52] U.S. Cl. ..... 254/104; 269/49

[58] Field of Search ..... 269/49, 234; 254/104

[56] References Cited

U.S. PATENT DOCUMENTS

| | | | |
|---|---|---|---|
| 759,868 | 5/1904 | Eich | 254/104 |
| 4,076,228 | 2/1978 | Sheldon | 269/49 |
| 4,161,311 | 7/1979 | Holman | 269/49 |

*Primary Examiner*—Frederick R. Schmidt
*Assistant Examiner*—Steven P. Schad
*Attorney, Agent, or Firm*—Biebel, French & Nauman

[57] ABSTRACT

A flanged wedge having a wedge body of conventional design with two to four flanges extending from the parallel planar surfaces of the wedge body. The wedge is used to separate the kerf of a board being cut to prevent binding of the saw. The flanges keep the wedge in position during the cutting and support the sides of the board at the cut end until the sawing is completed. Various flange sizes and shapes may be used.

12 Claims, 7 Drawing Figures

WEDGE WITH FLANGES

BACKGROUND OF THE INVENTION

This invention relates to wedges, and more particularly relates to flanged wedges used by carpenters in connection with sawing or cutting boards.

Among the difficulties which may arise when sawing or cutting boards of some size and length are the problems which are attendant to the binding of the saw blade. Thus, in many sawing environments, the cut space (termed the "kerf") will close and pinch the saw blade before the sawing or cutting is completed, making the sawing extremely difficult, if not impossible. This phenomenon is termed "binding".

In the logging industry binding is a long known problem. Accordingly, wedges are often used to keep the kerf open and prevent the saw from binding. Frequently, the use of a wedge alone was insufficient since the log would roll or twist and either dislodge the wedge or otherwise position itself so as to still pinch the saw. To prevent this early loggers would place a wedge into the kerf and, then, embed an axe over or beside the wedge, perpendicular to the saw cut and thereby prevent rolling or twisting of the log relative to the wedge. Various types of finned or winged wedges have also become available for that purpose. See, for example, Gravel, U.S. Pat. No. 1,192,185 and Courville U.S. Pat. No. 3,515,372. In both of these patents the wings or fins on the wedge are designed to cut into the log at an angle perpendicular to the saw cut and thereby keep the log from rolling into a twist as the wedge is driven into the kerf. Another function of the wings or fins is to hold the wedge firmly in place and prevent it from dropping away above the saw before the cut is completed.

In that regard Gravel and Courville are similar to Eich U.S. Pat. No. 759,868. Eich discloses a wedge having parallel ribs or flanges formed on the wedge. These ribs or flanges enter the kerf in the timber and embed themselves in the wood sufficiently to retain the wedge in position and prevent the same from being accidentally displaced when driving the wedge.

With all of these prior wedge designs, the rigidity of the log is necessary in order for the fins to embed themselves. If the kerf spreads easily, the wedges will not function properly. The two sides of the kerf will not remain fixed with respect to each other and the wedge may still be dislodged.

Besides, in modern carpentry it is totally unacceptable to use a wedge having fins which are intended to embed themselves into the wood as the wedge is driven into the kerf. This would unduely damage any board which is intended to be used as a building material after cut to shape. Accordingly, carpenters frequently resort to the use of standard wedges, screw drivers, or other devices placed in the kerf to prevent binding of the saw. However, those devices are easily dislodged as the sawing progresses. Thus, the device will drop out of the kerf when the cut is so far into the board that the weight of the unsupported side of the board drops or moves that portion of the board out of the plane relative to the other side.

Accordingly, there is a need for a wedge that can be used to spread the kerf and yet remain fixed in place as the sawing progresses without damaging the board with embedded fins. Likewise, there is the need in modern carpentry to keep the board in one plane (preventing the unsupported sawed part from dropping or moving) and keeping the wedge aligned properly in relation to the board.

SUMMARY OF THE INVENTION

The present invention meets that need by providing a unique wedge design having flanges attached to the wedge body. The flanges of the present design will keep the wedge aligned properly in relation to the board, will not damage the wood, and will provide additional support at the cut end of the board so as to keep the board in one plane. Most importantly, the wedge of the present invention performs the originally intended function, i.e., spreading the kerf to prevent the saw from binding, easily and in a superior manner.

Basically, the wedge body itself is of conventional design with two converging flat sides, two parallel planar surfaces, a generally rectangular blunt end (the corners may be rouned as is sometimes done) and a chisel end. It can be of various dimensional sizes and have varying angles of convergence of the flat sides of the wedge to the chisel and, although generally the thickness at the blunt end should be relatively greater than the thickness of the chisel end.

The wedge body can be made of different materials (such as metal, plastic, or even hard wood). The reason for the flexibility in that regard is that the wedge is for the most part not going to be forcefully driven into the kerf and it is not to be driven into the wood at all (i.e. it is not a splitting wedge as such). Rather, in use the leading edge of the wedge will simply be placed or lightly forced into the kerf opening and, then, slid (or forced as need be) further into the kerf until properly positioned. Such action does not under most circumstances require the tempered metals of conventional wedges to withstand sustained use.

In terms of placement of the wedge in the kerf, an additional advantage of the present wedge is that it can be easily relocated during the sawing process. Thus, as the sawing progresses, the wedge can be slid (or forced) further into the kerf and closer to the saw blade. When this is done, an additional wedge, of the same or different dimensions, may be inserted into the kerf opening if there is the need to maintain the support at that location on the board.

Thus, the attached flanges on the wedge help support the cut end of the board and keep the board essentially in one plane. Also, the flanges prevent the wedge from falling free once the kerf no longer holds the wedge body in place. The flanges of the present invention are non-cutting, support ones which are preferably rectangular in shape with a leading edge toward the chisel end of the wedge body and a trailing edge toward the blunt end. In the preferred embodiment the leading edge is aligned with the chisel end; whereas, the trailing edge is spaced inwardly somewhat from the blunt end. Also preferably, they are uniformly thick and extend on a coplane from the parallel planar surfaces of the wedge body. As an alternative, when two flanges on a side of the wedge body are present, those flanges may converge toward one another as they extend from the wedge body. This produces a spring clip-type action which will grip the board, as more fully explained below.

Either permanently fixed or removable flanges can be used. While they are preferably made of the same material as the wedge body, this is not required. Likewise, while four flanges of the same size and shape are preferred, two or three flanges may be used as will be described in more detail later, and the size and shape of the flanges even on a single wedge body may vary. Clearly, the size and shape of the flanges on different wedge bodies may vary in the same manner that the wedge body dimensions may vary depending on the particular features sought.

Thus, for most carpentry work the boards being sawed will range from ⅛–2 inches (unfinished) and, therefore, the finished boards are slightly less thick. If the wedge body is ⅛–2 inches thick as measured between the parallel planar surfaces the appropriately sized wedge body may be used with the correspondingly sized board. Thicker ones will, of course, be required for use with thicker boards but thicker ones can also be used with thinner boards in most instances and this is particularly true when spring clip-type flanges are used. Flanges extending 1–6 inches from the planar surface as measured at the blunt end are effective for the support purposes, although, larger ones may be used.

Accordingly, it is an object of the invention to provide a flanged wedge, the flanges of which, without damage to the board, will prevent the wedge from disloging and which will support the cut end of the board so as to keep the board essentially in one plane, and the wedge body itself being usable to keep the kerf open and prevent binding of the saw.

Other objects and advantages of the invention will be apparent from the following description, the accompanying drawing and the appended claims.

DETAILED DESCRIPTION OF THE PREFERRED EMBODIMENT

Figure 1:
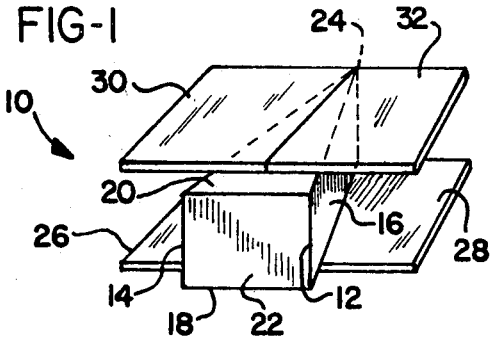
FIG. 1 is a perspective view of the preferred embodiment of the present invention showing a wedge body having four flanges.

Referring to the Figs., there is shown a wedge 10 having a wedge body 12 of conventional shape. That is, it has two converging flat sides 14 and 16 which serve as the separating surfaces of the wedge. Parallel planar surfaces 18 and 20 make up the other sides of the wedge body 12. The four sides form at the blunt end 22 a rectangle (which may be a square under some circumstances), and narrow to a point at the chisel end 24.

Figure 2:
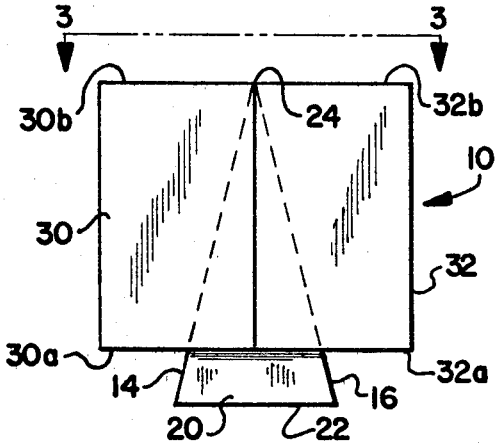
FIG. 2 is a top plan view thereof.
Figure 3:
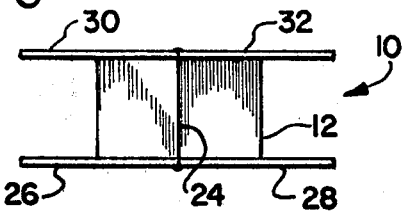
FIG. 3 is a front view thereof looking at the chisel end of the wedge body.
Figure 6:
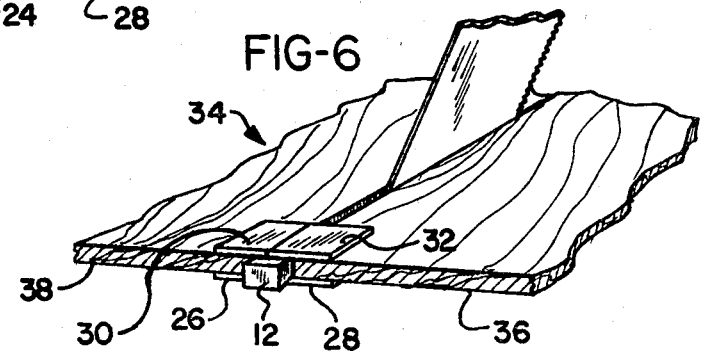
FIG. 6 is a perspective view of the wedge of the present invention in use.

In the preferred embodiment, as shown in FIGS. 1–3, there are four flanges 26, 28, 30, and 32 which are supported on the parallel planar surfaces 18 and 20 and extend therefrom. As also shown in FIGS. 1–3, flanges 26, 28 and 30, 32 may be unitary pieces; although, this is not necessary and it must, therefore, be considered that four flanges are shown. Thus, as shown in FIG. 6, flanges 28 and 32 will be adjacent the lower and upper faces, respectively, of the one (right) side 36 of the board 34 being sawed, wedge body 12 will at least partially be in the kerf, and flanges 26 and 30 will be adjacent the lower and upper faces, respectively, of the other (left) side 38 of the board 34 being sawed.

In this manner, both sides of the cut end of the board are held in the same relative plane. This prevents disloging of the wedge from the kerf as the sawing progresses.

Figure 4:
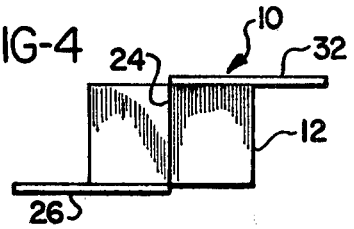
FIG. 4 is a front view of an alternative embodiment having only two flanges.

It is possible to achieve the same result with as few as two flanges. This alternative embodiment is shown in FIG. 4, where only flanges 26 and 32 are used. In this instance flange 26 would be adjacent the lower face of the unsupported side of the cut board and flange 32 would be adjacent the upper face of the side of the cut board which is resting (lower face down) on a supporting surface, i.e. the work bench or other support.

Figure 5:
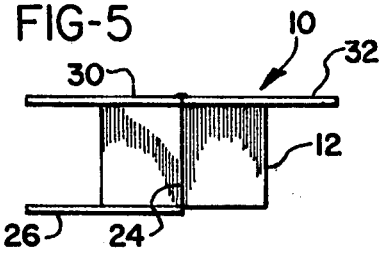
FIG. 5 is a front view of another alternative embodiment having three flanges.

Another alternative embodiment is shown in FIG. 5. There flanges 26 and 30 will be adjacent the lower and upper faces of the unsupported side of the cut board and flange 32 would be adjacent the upper face of the side of the cut board which is resting on the supporting surface.

Figure 7:
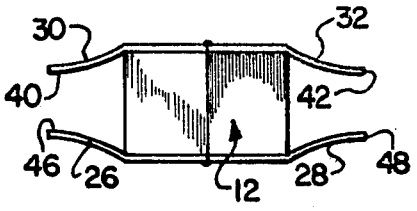
FIG. 7 is a front view of yet another alternative embodiment.

Yet another alternative is shown in FIG. 7. In that embodiment, a wedge body 12 is shown with four flanges 26, 28, 30 and 32, but unlike the embodiments shown in FIGS. 1–5, the flanges are not parallel to one another. Rather, flanges 26, 30 and 28, 32 converge toward one another and have slightly upturned ends, 40, 42, 46, and 48. Since the flange materials in this embodiment are somewhat thin and flexible, this produces a spring clip-type action which will grip the board even more firmly.

In all those embodiments, the unsupported side of the cut board receives enough support from the flanges alone to keep it generally in the same plane as the supported side of the cut board. As mentioned, this allows the wedge to perform its main function—keeping the kerf separated so as not to bind the saw—without being disloged and without damaging the wood.

The flanges need only be thick enough to provide this type of support. Generally, a relatively uniform thickness of 1/32–½" is sufficient depending on the material out of which the flanges are constructed. For instance, metal flanges, can obviously be somewhat thinner than plastic or wooden ones because of the greater relative strength and rigidity of most metals.

The shape of the flanges is also dictated by the degree of support required. While rectangular flanges are shown, semicircular, trapezoidal, or other shapes could be used. Flanges which extend from the wedge body at the blunt end up to 6 inches or more may be used. The appropriately shaped and sized flanges may be attached to the parallel planar surfaces of the wedge body by permanent means such as adhesive bonding or welding or they may be removably attached with screws, bolts, or other attachment means. Likewise, the flanges may be formed with the wedge body as a unitary piece by molding or casting.

Referring to FIG. 6, where the flanged wedge of the present invention is shown in use, when a sufficient saw cut is made in the board 34, the flanged wedge 10 is placed in the open end of the kerf, chisel end 24 first. Blunt end 22 may be used to receive hammer blows or the like to force the wedge into the kerf. For that purpose in the preferred embodiment the trailing edge of each flange is spaced inwardly from the blunt end so as to avoid hammer blows to the flanges. This is best illustrated in FIG. 2 where trailing edges 30(*a*) and 32(*a*) are shown inwardly spaced from blunt end 22. Also as shown in FIG. 2, leading edges 30(*b*) and 32(*b*) are preferably aligned with the chisel end 24. However, other spacings of the flanges could be used as well.

As the sawing progresses the flanged wedge may be driven or slid further into the kerf and closer to the saw blade. In this manner enough space is provided in the kerf to prevent binding of the saw. In order to continue support of the sides of the cut board at the cut end, additional flanged wedges may be inserted, as need be. This support is important for a carpenter to be able to finish his saw cut at the opposite end of the wood in a neat, clean manner. Without this support, the remaining, uncut portion of the board may splinter and break.

Thus, the present invention is most advantageous to the carpenter doing relatively exact cutting of partially finished and finished boards such as 4'×8' sheets of plywood. Generally those boards range between approximately ⅛–2 inches in thickness and, therefore, the thickness of the wedge body between the parallel planar surfaces should be in the same range. While the skilled carpenter will find it most convenient to have flanged wedges of several differing wedge body thicknesses, the larger ones are for the most part usable with boards of that thickness or less. This is particularly true of the embodiment shown in FIG. 7.

While the article herein described constitutes preferred embodiments of the invention, it is to be understood that the invention is not limited to this precise article, and that changes may be made therein without departing from the scope of the invention.

What is claimed is:

1. A flanged wedge having a wedge body with two converging flat sides, two parallel planar surfaces, a blunt end, and a chisel end, said blunt end of said wedge body being of relatively greater thickness between said two converging flat sides than the opposite chisel end thereof which is relatively narrowed, wherein the improvement comprises:

at least two non-cutting, support flanges, a first one of said flanges extending transversely of the longitudinal axis of the wedge body and away from the first of said converging sides at or near the first of said parallel planar surfaces and a second one of said flanges extending transversely of the longitudinal axis of the wedge body in a direction opposite said first one of said flanges and away from the second of said converging sides at or near the second of said planar surfaces, each said flange at the leading edge extending away from said longitudinal axis of the wedge body a distance which is greater than one-half the thickness of said wedge body at said blunt end.

2. The flanged wedge of claim 1 wherein each said flange at both the leading edge and the trailing edge extends away from said longitudinal axis of said wedge body a distance which is greater than one-half the thickness of said wedge body at said blunt end.

3. The flanged wedge of claim 2 wherein each said flange meets said converging side from which it extends at a perpendicular angle.

4. The flanged wedge of claim 1 wherein there are two flanges, one extending co-planar from each of said two parallel planar surfaces.

5. The flanged wedge of claim 1 wherein there are three flanges, one extending co-planar from said first parallel planar surface and two extending co-planar in opposite directions from said second parallel planar surfaces.

6. The flanged wedge of claim 1 wherein there are four flanges, two extending in opposite directions from said first parallel planar surface and two extending in opposite directions from said second parallel planar surfaces.

7. The flanged wedge of claim 6 wherein said flanges are each of the same size and shape and extend co-planar from said parallel planar surfaces.

8. The flanged wedge of claim 7 wherein said flanges are rectangular and the leading edge of said flanges is aligned with said chisel end of said wedge body.

9. The flanged wedge of claim 8 wherein said trailing edge of said flanges is spaced inwardly from said blunt end of said wedge body.

10. A flanged wedge having a wedge body with two converging flat sides, two parallel planar surfaces, blunt end, and a chisel end, said blunt end of said wedge body being of relatively greater thickness between said two converging flat sides than the opposite chisel end thereof which is relatively narrowed, wherein the improvement comprises:

four non-cutting, support flanges, two extending in opposite directions from said first parallel planar surface and two extending in opposite directions from said second parallel planar surface, each said flange being relatively uniformly thick and having a leading edge toward said chisel end of said wedge body and a trailing edge toward said blund end, said flanges each also being of the same size and shape and the pair extending in one direction converge toward one another, while the pair extending in the opposite direction also converge toward one another, to produce a spring clip-type action for each pair of flanges.

11. The flanged wedge of claim 10 wherein said wedge body is approximately one-eight inch to two inches thick between said two parallel planar surfaces.

12. The flanged wedge of claim 10 wherein said flanges extend approximately one to six inches from said parallel planar surfaces as measured at the blunt end of said wedge body.

* * * * *